US007796092B2

(12) United States Patent
Holly et al.

(10) Patent No.: US 7,796,092 B2
(45) Date of Patent: Sep. 14, 2010

(54) BROADBAND COMPOSITE DIPOLE ANTENNA ARRAYS FOR OPTICAL WAVE MIXING

(75) Inventors: Sandor Holly, Woodland Hills, CA (US); William Daniel Mack, Encino, CA (US)

(73) Assignee: The Boeing Company, Chicago, IL (US)

( * ) Notice: Subject to any disclaimer, the term of this patent is extended or adjusted under 35 U.S.C. 154(b) by 313 days.

(21) Appl. No.: 11/753,490

(22) Filed: May 24, 2007

(65) Prior Publication Data

US 2008/0291108 A1 Nov. 27, 2008

(51) Int. Cl.
*H01Q 9/16* (2006.01)

(52) U.S. Cl. ..... 343/820

(58) Field of Classification Search ..... 343/820, 343/852, 793

See application file for complete search history.

(56) References Cited

U.S. PATENT DOCUMENTS

| | | | | |
|---|---|---|---|---|
| 3,852,755 | A | 12/1974 | Works et al. | |
| 3,919,638 | A | 11/1975 | Belden, Jr. | |
| 4,634,968 | A | 1/1987 | Aslan | |
| 4,638,813 | A | 1/1987 | Turner | |
| 5,030,962 | A | 7/1991 | Rees | |
| 5,420,595 | A * | 5/1995 | Zhang et al. | 342/368 |
| 6,492,957 | B2 | 12/2002 | Carillo, Jr. et al. | |
| 6,762,726 | B2 * | 7/2004 | Alden et al. | 343/703 |
| 7,142,147 | B2 * | 11/2006 | Holly | 342/13 |
| 7,205,891 | B1 * | 4/2007 | McGlothlin et al. | 340/539.26 |
| 7,486,250 | B2 * | 2/2009 | Vetrovec et al. | 343/820 |
| 2002/0075189 | A1 | 6/2002 | Carillo, Jr. et al. | |
| 2004/0008149 | A1 | 1/2004 | Killen et al. | |
| 2005/0088358 | A1 | 4/2005 | Larry et al. | |

(Continued)

FOREIGN PATENT DOCUMENTS

| | | |
|---|---|---|
| EP | 01101006 | 4/1989 |

(Continued)

OTHER PUBLICATIONS

PCT search report of Jul. 21, 2008.

(Continued)

*Primary Examiner*—Huedung Mancuso
(74) *Attorney, Agent, or Firm*—Haynes and Boone, LLP

(57) ABSTRACT

A broadband composite dipole array (CDA) includes an array of macro dipoles on a non-conducting substrate adapted to receive radiation at two frequencies. Each macro dipole is an array of micro dipoles adapted to receive radiation at substantially the mean of the two frequencies. The micro-dipoles are coupled to each other by a parallel resonant circuit including a nonlinear element, wherein the minimum impedance of the circuit is a substantially short circuit at the difference frequency f1−f2, and the circuit has a substantially open circuit impedance in the range of frequencies from f1 to f2. The micro dipoles resonate efficiently at both frequencies f1 and f2 with low-loss. The nonlinear element in the resonant circuit generates a signal at the difference frequency which is the resonant frequency of the macro dipole antenna. A composite of macro dipole antennas couple electromagnetically via a cluster of micro-dipole elements to broaden the bandwidth over a range of frequencies from f1 to f2 at which the macro dipole antenna resonates.

15 Claims, 7 Drawing Sheets

U.S. PATENT DOCUMENTS

| | | | |
|---|---|---|---|
| 2005/0179606 | A1 | 8/2005 | Holly |
| 2005/0179611 | A1 | 8/2005 | Holly |
| 2005/0179612 | A1 | 8/2005 | Holly et al. |

FOREIGN PATENT DOCUMENTS

| | | | |
|---|---|---|---|
| GB | 2121612 | A | 12/1983 |
| JP | 2006-211637 | | 8/2006 |
| JP | 2006211637 | | 8/2006 |
| WO | 03/019738 | A1 | 3/2003 |
| WO | 2005/093904 | A1 | 10/2005 |
| WO | PCT/US2006/005057 | | 2/2006 |
| WO | 2006088802 | A2 | 8/2006 |

OTHER PUBLICATIONS

Terahertz Technology, IEEE transactions on microwave theory & tech. Mar. 2002.

THZ Technolgy: An Overview, International Journal of High Speed Electronics & Systems, Mar. 2002.

Off-Axis Properties of Silicon & Quartz Dielectric Lens Antennas, IEEE transactions on microwave theory & tech. May 1997.

A W-Band Dielectric-Lens-Based Integrated Monopulse Radar Receiver, IEEE transactions on microwave theory & tech. Dec. 1998.

A Novel Lateral Field Emitter Triode With Insitu Vacuum Encapsulation, IEDM.

Micormachining Technology for Lateral Field Emission Devices, IEEE transactions on microwave theory & tech. Jan. 2001.

* cited by examiner

BROADBAND COMPOSITE DIPOLE ANTENNA ARRAYS FOR OPTICAL WAVE MIXING

TECHNICAL FIELD

The present invention relates to broadband composite dipole antennas for broadband electromagnetic wave detection and emission.

BACKGROUND

A composite dipole antenna (CDA) structure forming an element of a larger array element, described in U.S. Pat. No. 6,999,041, (filed Feb. 16, 2004, issued Feb. 14, 2006, which is incorporated herein by reference in its entirety) contains a string of alternating resonant circuits. The function of the CDA array element is to receive radiation signals at two frequencies and reradiate a single signal at the difference frequency. This may be accomplished if the antenna incorporates one or more nonlinear device elements to achieve the conversion. One of the two circuit types is primarily a dipole antenna, and the second is primarily an impedance matching element between adjacent dipole antenna circuits. The second circuit type may contain, in addition to impedance matching components, a nonlinear device for enabling the frequency conversion. The quality (Q) value of these resonant circuits is an important characteristic that determines (among other parameters) the conversion efficiency of the CDA structure. The Q values of the resonant circuits are dependent on the various losses that are associated with them. Both circuit types may have conduction, dielectric and radiation losses. For various applications the CDA structure may be illuminated with electromagnetic beams of at least two frequencies f1 and f2 (where f1−f2=Δf, the difference frequency). In this case, both beams and also the difference frequency need to interact with both circuits of the CDA structure.

Where f1 and f2 are widely separated (in order to achieve a large value for Δf, i.e., cases where, for example, Δf>1% of f1,2) it may be necessary to lower the Q of both circuit types in order to facilitate an interaction between the fields and circuits, thus introducing losses that are undesirable from the point of view of conversion efficiency. In many cases it is required to design a CDA that operates with large Δf values (e.g., Δf>10% of f1,2, where f1,2~(f1+f2)/2). Until now, broad band frequency generation, particularly in the millimeter and submillimeter wavelength terahetz frequency ranges have not been effectively achieved. As a result, there is a need to design CDA structures having both broad bandwidth capability and low losses.

SUMMARY

Systems and methods are disclosed herein that allow the elements in a composite dipole antenna (CDA) array to operate as broad-band structures with low loss.

In one embodiment, a composite macro dipole antenna array includes at least one non-conducting substrate on which a plurality of macro composite dipole antennas are disposed on the substrate generally parallel to and spaced apart from each other. The array receives energy at a first and a second frequency and radiates energy at a frequency that is the difference of the first and second frequencies.

In another embodiment, a composite macro dipole antenna array includes at least one non-conducting substrate on which a plurality of macro composite dipole antennas are disposed on the substrate generally parallel to and spaced apart from each other. A plurality of clusters of dipole elements are placed between one or more of the plurality of macro composite dipole antennas to electromagnetically couple the antennas. The array receives energy at a first and a second frequency and radiates energy at a frequency that is the difference of the first and second frequencies. The coupling broadens the difference between the first and second frequencies at which the array will operate to radiate the difference frequency energy.

In another embodiment, a method of converting frequencies using a macro composite dipole antenna array, includes transmitting to a macro composite dipole antenna array a first electromagnetic beam at a first frequency and a second electromagnetic beam at a second frequency offset from the first frequency by a third frequency which is a difference frequency. The macro composite dipole antenna array radiates a beam at the third frequency.

In another embodiment, a method of converting an image provided with electromagnetic radiation at one frequency to an image provided with electromagnetic radiation at another frequency includes focusing a first image provided by a first beam of electromagnetic radiation at a first frequency on a macro composite dipole antenna array. The macro composite dipole antenna array is illuminated with a second beam of electromagnetic radiation at a second frequency. The macro composite dipole antenna array generates a third electromagnetic beam with a third frequency that is the sum or difference of the first and second frequencies. The third beam is imaged with an imaging device adapted to detect radiation at the third frequency.

Although the exemplary embodiments have been described, it is understood that the present invention should not be limited to these exemplary embodiments but various changes and modifications can be made by one of ordinary skilled in the art within the spirit and scope of the present invention as hereinafter claimed. For example, vertical and horizontal are terms used for convenience with reference to the accompanying figures for description without reference to a fixed frame of reference, and various elements described may be arranged alternatively to achieve the same result.

The scope of the disclosure is defined by the claims, which are incorporated into this section by reference. A more complete understanding of embodiments will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments and their advantages are best understood by referring to the detailed description that follows. It should be appreciated that like reference numerals are used to identify like elements illustrated in one or more of the figures.

DETAILED DESCRIPTION

The present disclosure provides structures that allow a plurality of macro composite dipole antenna (CDA) elements in a CDA array to operate as a broad-band system. To achieve this, the various parts of the macro dipole antenna elements must be designed to have matched broad-band characteristics. Furthermore, a method of broadening the frequency response characteristics may be developed to enable low-loss generation of broadband frequency conversion.

It is a known approach in strip-line type radio frequency (RF) filter designs to use coupled resonant elements (such as clustered dipoles) for producing RF circuits that have broadband characteristics. These techniques are adapted herein to produce arrays and groups of coupled micro dipoles that have broadband characteristics to accommodate two or more incoming radiation signal frequencies, f1 and f2, separated by $\Delta f = f1 - f2$, without introducing substantial losses by lowering the Q values of the circuit elements and provide an output signal at the difference frequency $\Delta f$. Additionally, arrays and groups of dipoles may be adapted to accept source signals at frequencies f1 and $\Delta f$, and radiate a directed beam comprised of signals at f1 and a second frequency f2 offset by $\Delta f$, i.e., $f2 = f1 +/- \Delta f$.

Clusters of coupled dipoles can be designed to produce distinct multi-pole broadband resonance behavior, resulting in a low-loss frequency bandwidth range $\Delta f$ from f1 to f2 as a result of electromagnetic coupling between dipole elements due to physical proximity. If properly designed, a coupled dipole array incorporating dipole clusters may have a uniformly low loss response over the broadened bandwidth $\Delta f$. Software packages such as Genesis by Eagleware (Agilent) are suited to design and calculate characteristics of such "strip-line"-type dipole resonant structures on non-conducting substrates (not shown).

Figure 1:
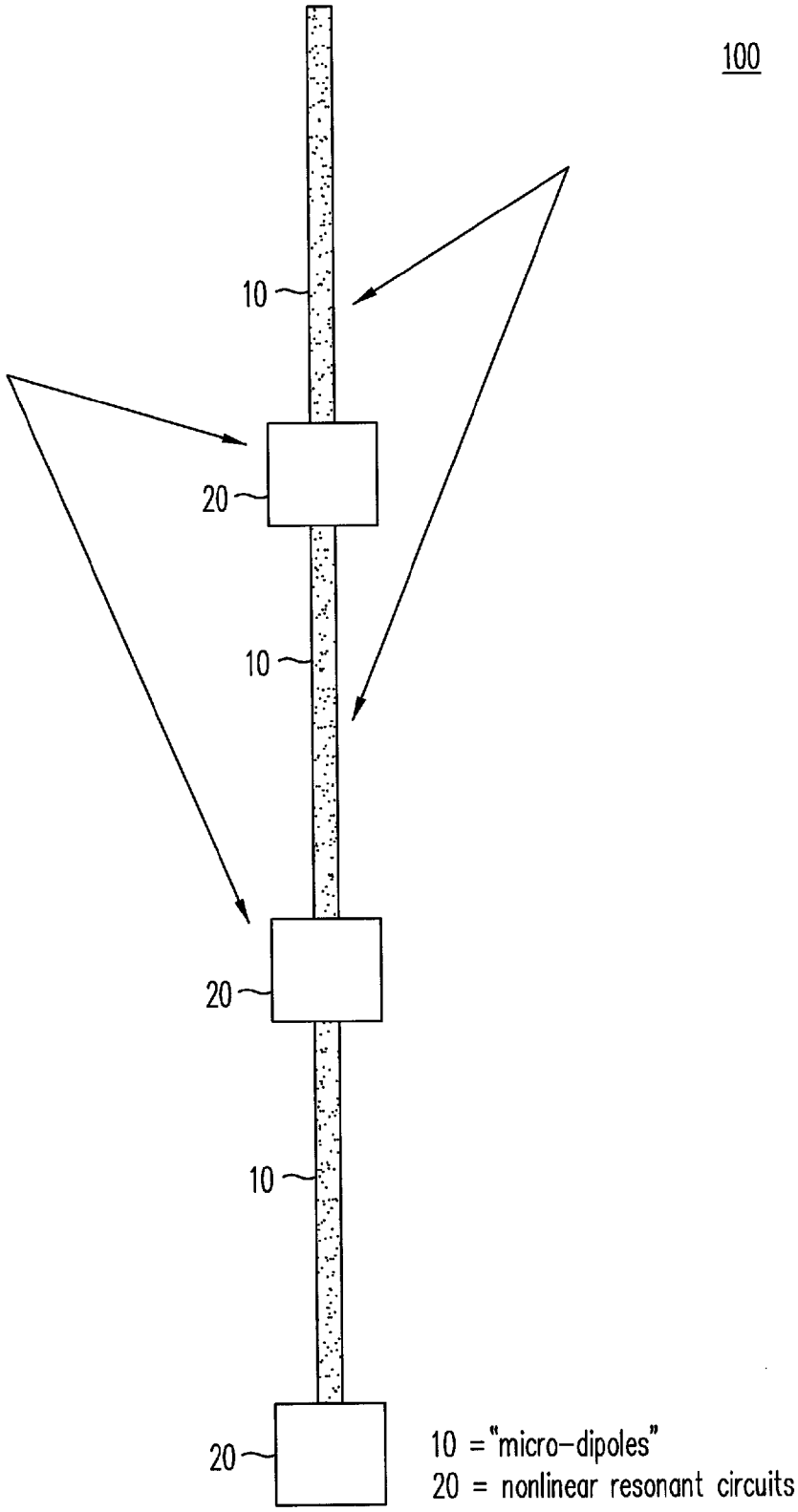
FIG. 1 (Prior Art)
FIG. 1 shows a portion of a macro composite dipole antenna (CDA) array element.

Referring to FIG. 1, a macro composite dipole antenna (CDA) structure 100 contains a vertically arranged string of alternating resonant circuits 10 and 20. The Q value of these resonant circuits is an important characteristic that determines (among other parameters) the conversion efficiency of the CDA. The Q values are dependent on various factors, including conduction and dielectric losses that are associated with components of circuits 10 and 20, and the substrate on which the circuits are formed. Circuit 10 is a half-wave micro dipole antenna 10 that may be formed, for example, as a transmission microstrip on a non-conducting substrate. Each micro dipole antenna 10 may be, for example, a microstrip structure substantially equal in length to a half wavelength at a frequency corresponding approximately to the midpoint frequency between the two frequencies f1 and f2. Losses may include both electrical dissipation and in addition, being an antenna, also radiation loss, which may limit the upper value of Q. Circuit 20 is substantially parallel resonant at the incident frequencies f1 and f2, i.e., an open circuit, the significance of which will be further described below. Circuit 20 may be implemented, for example, with a quarter wave long parallel transmission microstrip, discrete components, or a combination of the two. Circuit 20 further includes a nonlinear component for mixing two signals of different frequencies to generate signals with a sum and difference frequency of the two. An example of such nonlinear components may be a diode, which may be physically implemented in various ways in circuit 20 on the non-conducting substrate. Circuit 20 loss mechanisms may include both electrical dissipation and radiation.

Figure 2:
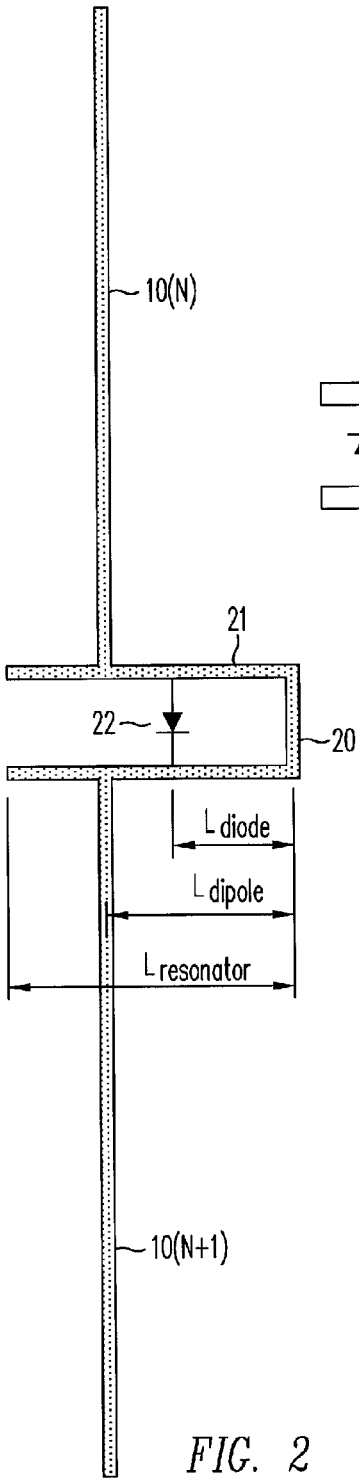
FIG. 2 shows an embodiment of a nonlinear parallel resonant circuit in accordance with an embodiment of the disclosure.
Figure 3:
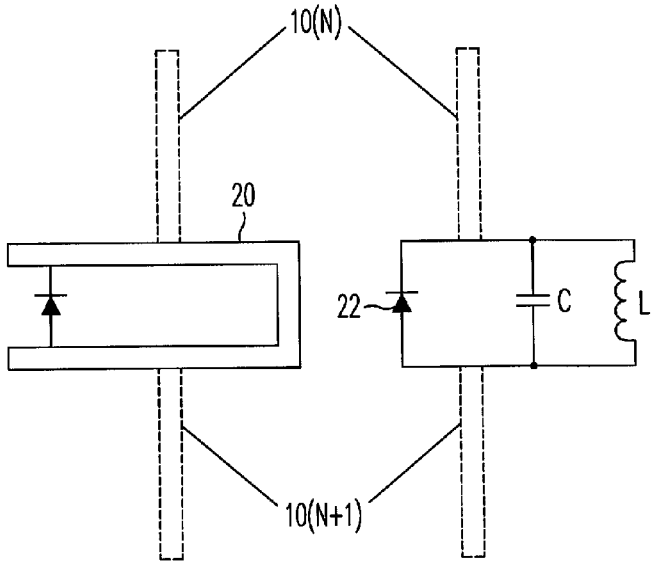
FIG. 3 shows an equivalent circuit representation of the nonlinear parallel resonant circuit, in accordance with the embodiment of FIG. 2.

For example, Circuit 20 may be implemented between facing ends of two microstrip micro dipole antennas 10, for example as a "U-shaped" quarter wave transmission line 21, as shown in FIG. 2, with an additional nonlinear element incorporated, such as a diode 22. Circuit 20 may be characterized dimensionally at least by $D_{resonator}$, the length of the two "legs" of the quarter wave transmission line, $D_{dipole}$, the location of the attachment position of the "U-shaped" transmission line 21 relative to the micro dipole antennas, and $D_{dipole}$, the position of the nonlinear component (e.g., diode 22) within the "U-shaped" transmission line 21. The equivalent circuit may be approximately described as shown in FIG. 3, which includes the diode 22, an equivalent capacitance C corresponding to the proximity of the two parallel parts of the quarter wave transmission line, and an equivalent inductance £ corresponding to the U-shaped path the current must follow. Dissipative losses, characterized by a resistance R (not shown) may also be included but, if the dimensions of the conductive trace of the quarter wavelength transmission line are properly chosen (i.e., conductor width, length and thickness) dissipative loss may be minimized. However this may still place an upper bound on the Q value. R may include dissipation from both radiation and electrical resistivity. For simplicity in the following discussion, resistive loss in the conductor is ignored. When the quarter wave transmission line is properly designed to determine the values of C and £, the parallel combination of reactive elements behave substantially as an open circuit at the incident frequencies f1 and f2, and as a short circuit at the difference frequency, i.e., at $\Delta f = f1 - f2$. The nonlinear element generates frequency components including the sum and difference of f1 and f2. For this example, the difference frequency $\Delta f = f1 - f2$ is of interest. Alternatively, in various implementations, for radiation of selected incident frequencies f1 and f2, the nonlinear element may be relied upon to generate a sum frequency $f' = f1 + f2$, and the details of design of circuit 20, micro dipole antenna element 10 and CDA element 100 may be varied accordingly.

In the example of the transmission microstrip design shown in FIG. 3, circuit 20 is substantially open circuit at frequencies f1 and f2, while at the resonance frequency Δf, a standing wave voltage is generated with a spatial amplitude distribution along the two parallel elements of the quarter wave transmission line. The impedance of diode 22 may be matched to the impedance along the quarter-wave transmission line by choosing the appropriate location to attach diode 22, i.e., $D_{dipole}$, where nonlinear generation of Δf may be most efficient. Location of diode 22 at the appropriate location may be defined as the location at which circuit 20 is impedance matched to circuit 10.

Figure 4:
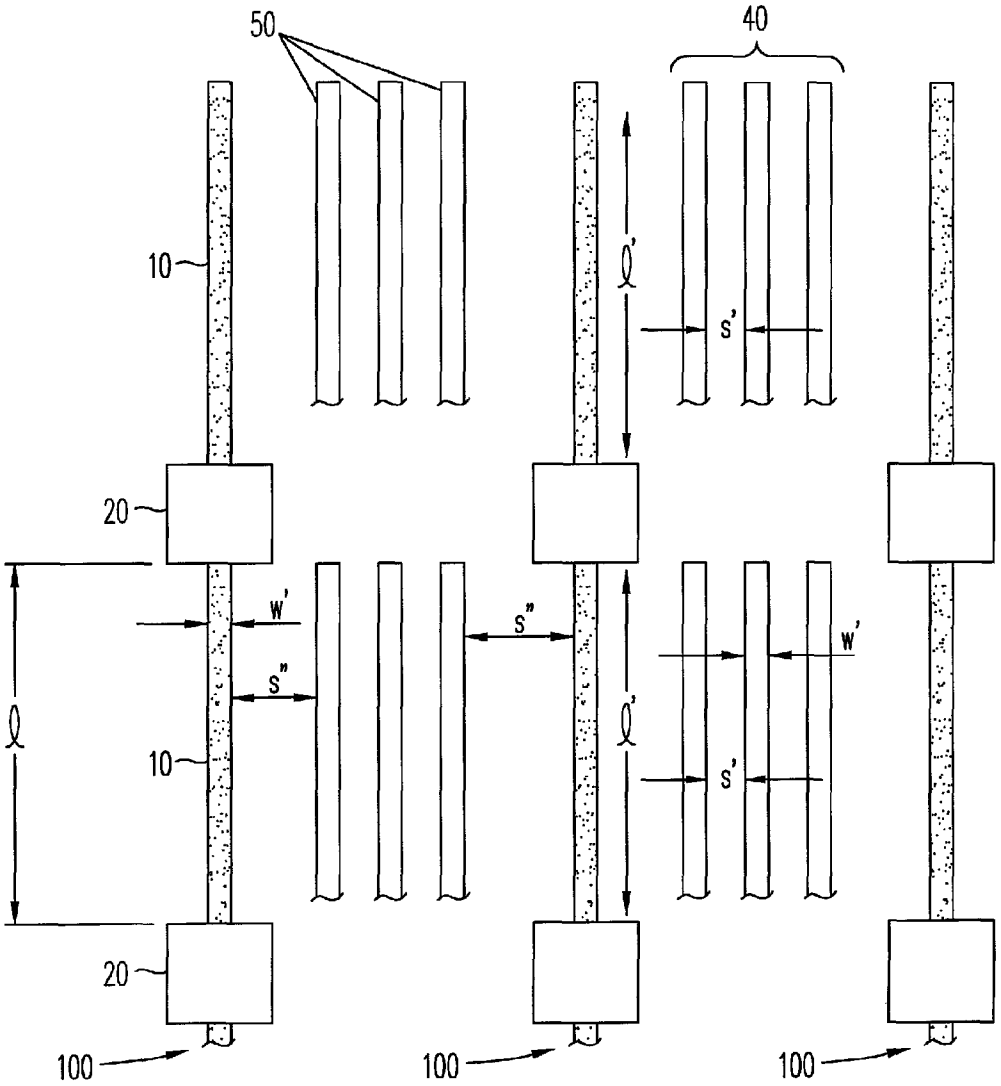
FIG. 4 shows a parallel configuration of several micro dipole elements disposed between several macro dipole antenna structures, in accordance with an embodiment of the disclosure.
Figure 5:
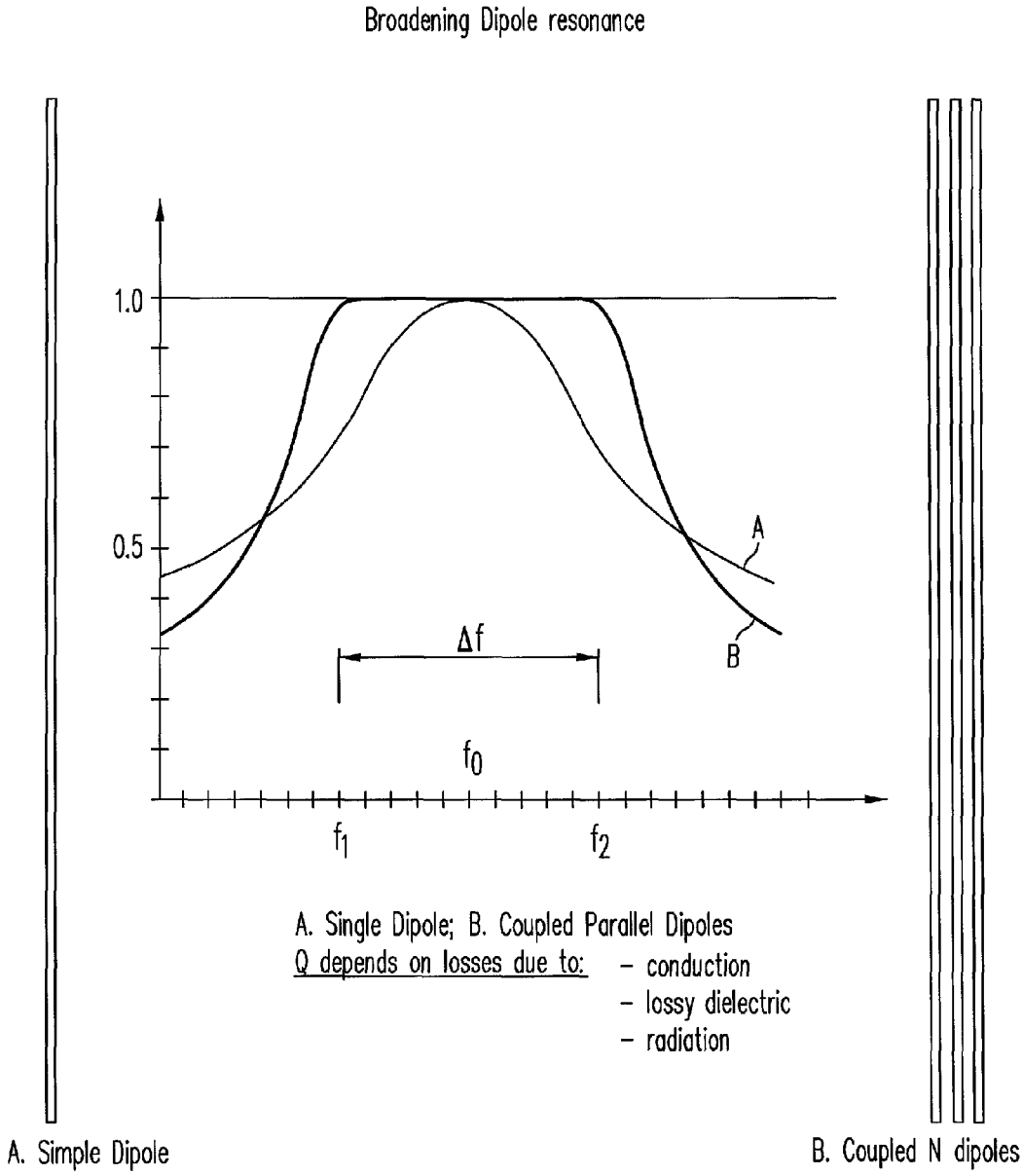
FIG. 5 shows the frequency response of a single micro dipole antenna (A) and the frequency response of dipole antennas coupled by a plurality of parallel coupled dipole elements (B), in accordance with an embodiment of the disclosure.

By placing micro dipole antennas 10 in parallel proximity to clusters 40 of micro dipole elements 50, as shown in FIG. 4, electromagnetic coupling between parallel micro dipoles 10 results in multi-pole coupling and broadening of the single resonance frequency to a bandwidth which, by design, is Δf. Cluster 40 may or may not be disposed in all spaces between micro dipoles 10. FIG. 5 shows an example of the resonance broadening that may occur when clusters 40 of micro dipole elements 50 are disposed to enable coupling between two adjacent micro dipole antennas 10. The length of composite macro dipole antenna element 100 is selected to correspond to the half wavelength at Δf, hence the term composite, meaning the structure operates in two fundamentally different frequency ranges—one at Δf, and another at substantially in the range between f1 and f2. At the frequency Δf=f1−f2, when circuit 20 is parallel non-resonant (i.e., at frequencies far from f1 and f2) and behaves substantially like a short circuit, the entire length of the linear array of micro dipole antennas 10 and circuits 20 behave like a single larger macro composite dipole antenna element 100, where the length is chosen to correspond to a half wavelength at the frequency Δf=f1−f2, as mentioned above.

The frequency Δf=f1−f2 is chosen by selecting values for various parameters that determine the behavior and coupling of micro dipoles 10 to each other via coupling through the cluster 40 of micro dipole elements 50. Referring to FIG. 4, a single conductive micro dipole antenna 10 may be described geometrically by length l and width w in the plane of the dielectric substrate upon which it is formed, and conductor thickness t. The conductor thickness t may be chosen to be greater than the skin depth for penetration of the electromagnetic field of the radiation. A larger value of t will result in a lower loss factor, and consequent higher efficiency.

The substrate dielectric constant ∈, and the substrate thickness are also critical parameters in the characterization and design of micro dipole antenna 10, circuit 20 and the coupling cluster 40 between parallel adjacent macro dipole antenna elements 100. For example, for a given substrate dielectric constant ∈, length l and width w (and resistivity ρ) the micro dipole antenna 10 length l corresponds to approximately a half wavelength at a given frequency (e.g., approximately (f1+f2)/2). Similar parameters will apply to the micro dipole elements 50 formed as clusters 40, i.e., having values t', l', w', s', and optionally ρ'. Placing a cluster 40 of two or more parallel micro dipole elements 50 between adjacent micro dipole antennas 10 of adjacent macro dipole antenna elements 100, and properly selecting in addition the separation s" between the first and last micro dipole elements adjacent to micro dipole antennas 10 result in electromagnetic coupling across the structure, thus causing a broadening of the resonance associated with a single micro dipole antenna 10 into a band from f1 to f2, where Δf=f1−f2. FIG. 5 shows an example of bandwidth broadening that may be obtained.

The design process may be iterative, in order to optimize the design of the coupled system. For example, the optimal lengths l and l' of both micro dipole antennas A and micro dipole elements may be affected as w, t, and s are varied to obtain a desired bandwidth Δf, but may still be similar to the effective half wavelength of the micro dipole A corresponding to a frequency $f_{1,2}$~(f1+f2)/2 in the absence of coupling clusters 40. In this circumstance, the effective half wavelength is termed an "electrical" half wavelength because both the coupling effects and dielectric constant ∈ of the supporting substrate affect all dimensional parameters required to optimize operating condition.

Changing the number and dimensions of micro dipole elements 50 in parallel may result in different degrees of coupling, further affecting the magnitude of Δf. As indicated above, commercially available microstrip design software may be used to design structures with the desired wavelength and bandwidth behavior.

As described above, a one dimensional macro composite dipole antenna (CDA) structure 100 may be coupled to a plurality of additional macro composite dipole antenna (CDA) structures 100 via a plurality of micro dipole element clusters 40 to form a two dimensional composite dipole antenna (CDA) array comprising a single row of coupled composite dipole array (CDA) antenna structures 100, i.e., a one dimensional composite dipole antenna (CDA) array.

Figure 6:
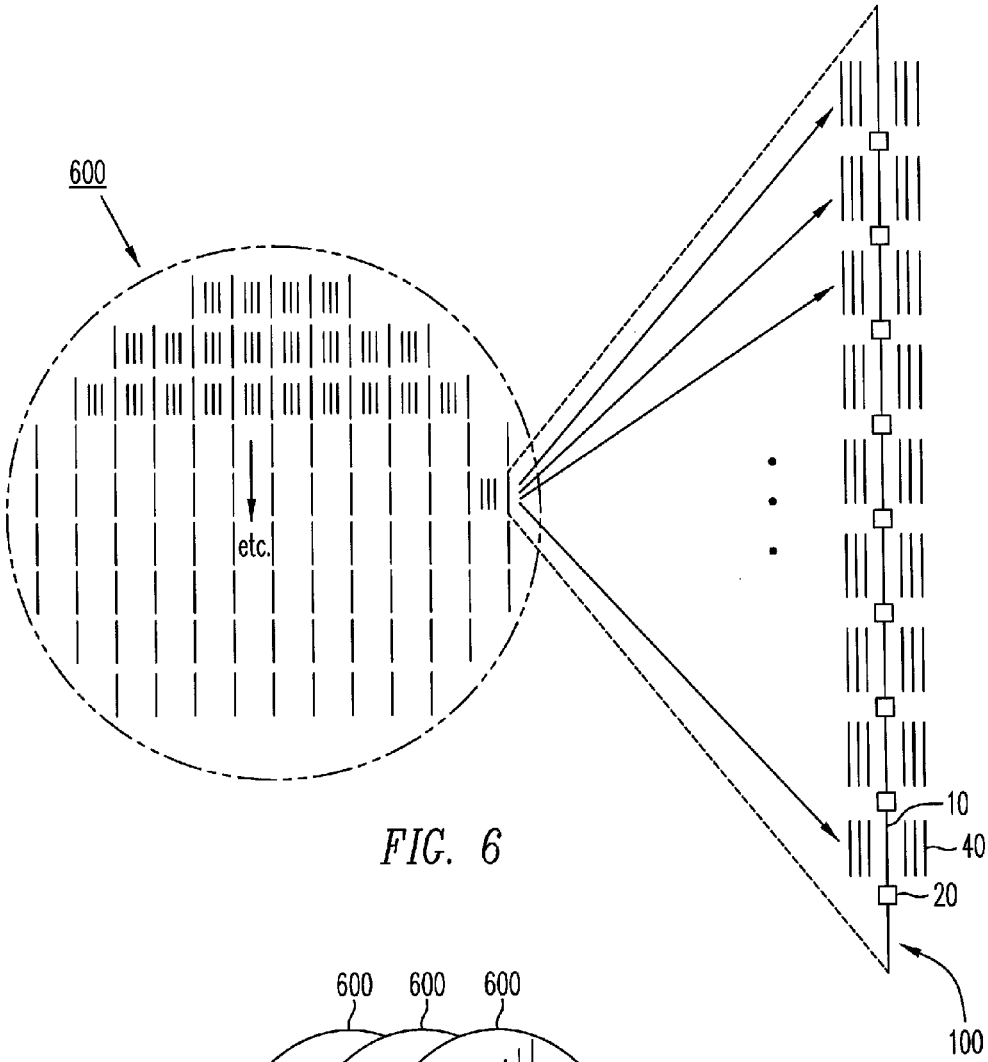
FIG. 6 shows a 2-dimensional array of coupled macro composite dipole antenna structure arrays, in accordance with an embodiment of the disclosure.

In accordance with another embodiment of the disclosure, the one dimensional composite dipole array (CDA) antenna may be replicated on the same substrate in a plurality of rows of antennas to form a two dimensional composite dipole antenna (CDA) array. FIG. 6 is an exemplary illustration of a two dimensional CDA array 600.

Figure 7:
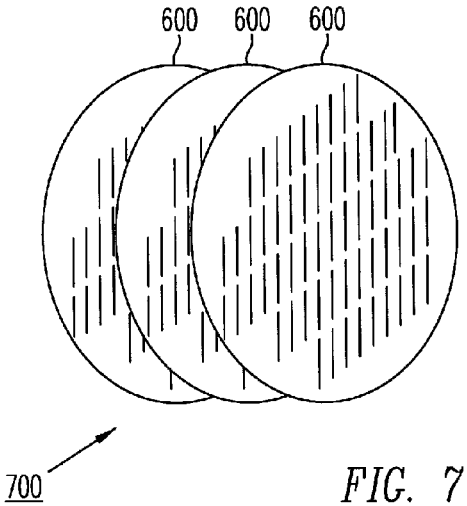
FIG. 7 shows a 3-dimensional array of coupled macro composite dipole antenna structure arrays disposed on several parallel substrates, in accordance with an embodiment of the disclosure.

In accordance with another embodiment of the disclosure, referring to FIG. 7, the two dimensional composite dipole antenna (CDA) array 600 may be formed on a plurality of non-conducting substrates, and the substrates arranged to form a three dimensional composite dipole antenna (CDA) array 700. Alternatively, the composite dipole array (CDA) antennas may be formed on a single substrate (not shown), where each two dimensional composite dipole array (CDA) antenna is formed on a nonconductive insulating layer that separates each two dimensional composite dipole array (CDA) antenna. Additionally, a plurality of layers separating each two dimensional composite dipole array (CDA) antenna may be interleaved with layers which include micro dipole elements 50 configured to form a plurality of coupling clusters 40 to couple micro dipole antennas 10 in layers containing the two dimensional composite dipole antennas (CDA) array. Therefore, a three dimensional composite dipole array (CDA) antenna 700 may be formed which incorporates coupling controlled bandwidth broadening aspects in more than one dimension.

Figure 8:
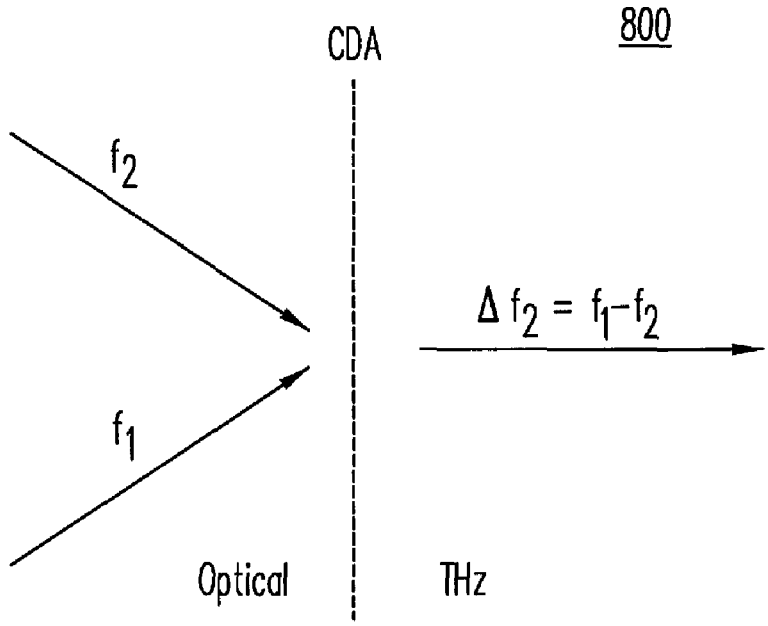
FIG. 8 is a schematic illustration of the coupling of radiation at two optical frequencies by an array of composite dipole antenna structures to generate radiation at a difference frequency, in accordance with an embodiment of the disclosure.

In another embodiment in accordance with the disclosure, a method 800, as shown in FIG. 8, of using a composite dipole antenna (CDA) array includes illuminating the antenna with electromagnetic radiation signals of at least two frequencies f1 and f2, wherein the antenna mixes the two signals nonlinearly and radiates an electromagnetic signal of frequency Δf=f1−f2. As an example, two optical frequencies may mix in a CDA antenna to emit an electromagnetic beam at terahertz frequencies.

Figure 9:
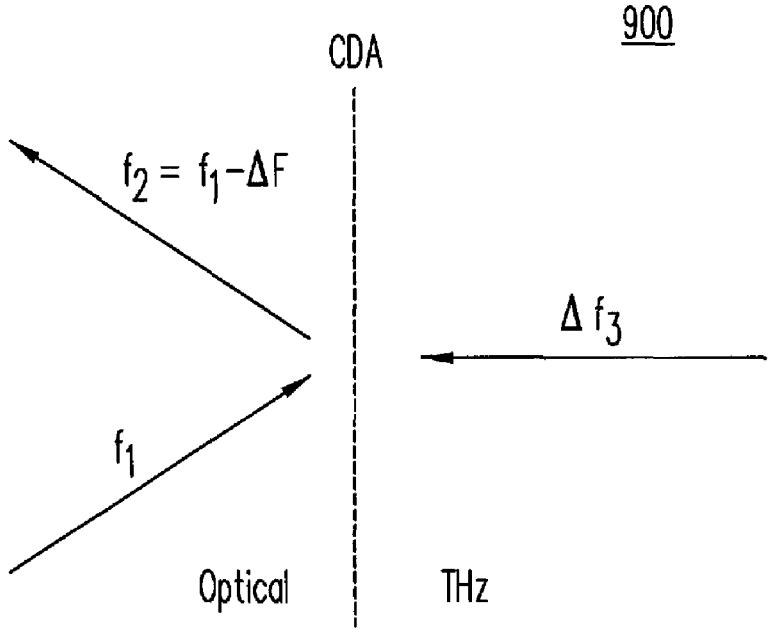
FIG. 9 is a schematic illustration of the coupling of radiation at a first optical frequency and radiation at a difference frequency by a composite dipole antenna array to generate radiation at a second, higher optical frequency, in accordance with another embodiment of the disclosure.

In another embodiment in accordance with the disclosure, as shown in FIG. 9, a method 900 of using a composite dipole array (CDA) antenna includes illuminating the antenna with electromagnetic radiation signals of at least two frequencies, i.e., f1 and Δf, wherein the antenna mixes the two signals nonlinearly and transmits a one or more electromagnetic signal of frequency f2=f1+/−Δf. As an example, an optical frequency f1 may mix in a CDA array with a terahertz frequency Δf to emit an electromagnetic beam at an optical frequency f2=f1−Δf and/or an optical frequency f3=f1+Δf.

Figure 10:
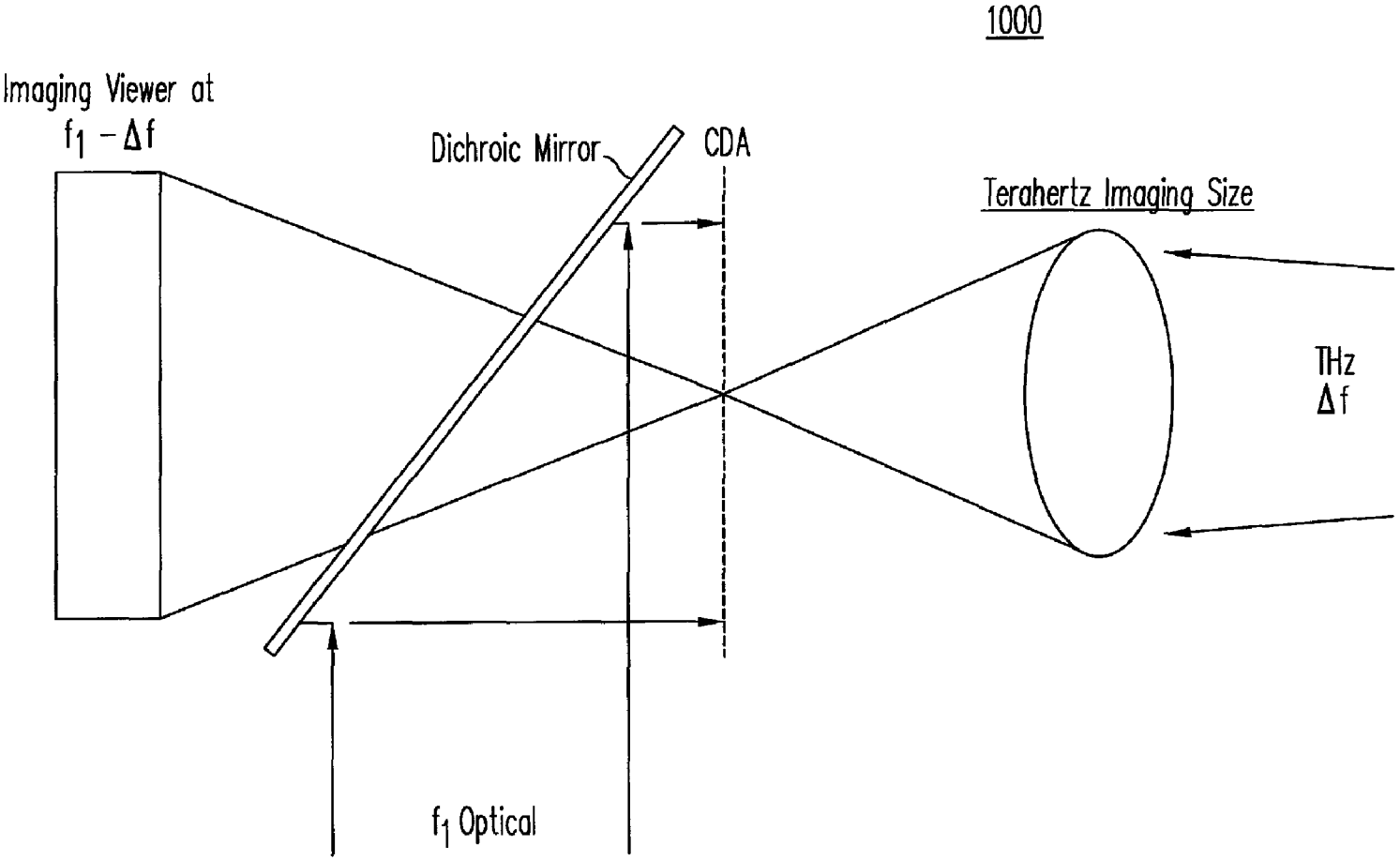
FIG. 10 is a schematic illustration of a system for converting an image provided at a difference frequency by mixing (i.e., coupling to) radiation at a first optical frequency to generate an image at a second optical frequency, in accordance with another embodiment of the disclosure.

In another embodiment in accordance with the disclosure, a method 1000, as shown in FIG. 10, using a composite dipole antenna (CDA) array includes focusing at the antenna array an electromagnetic radiation signal comprised of an image at a wavelength Δf, illuminating the composite dipole antenna (CDA) array with an electromagnetic radiation beam at a frequency f1, wherein the composite dipole antenna (CDA) array mixes the two signals and transmits an image at the frequencies f2=f1−Δf and f3=f1+Δf, and viewing the transmitted image with a detecting sensor adapted to receive radiation at one or both frequencies f2 and f3.

Embodiments described above illustrate but do not limit the invention. It should also be understood that numerous modifications and variations are possible in accordance with the principles of the present invention. Accordingly, the scope of the invention is defined only by the following claims.

We claim:

1. A composite macro dipole antenna array comprising:

at least one non-conducting substrate;

a plurality of macro composite dipole antennas disposed on the substrate generally parallel to each other, each macro composite dipole antenna comprising a plurality of micro dipole antennas arranged in a linear column array in one dimension on the substrate surface; and a plurality of reactive circuits including a nonlinear component disposed between each of the micro dipole antennas and electrically coupled to the micro dipoles, each reactive circuit comprising a quarter wave transmission line that is substantially parallel resonant at the frequencies f1 and f2.

2. The antenna array of claim 1, further comprising:

a plurality of micro dipole elements arranged on the substrate surface spaced apart from and parallel to each other and disposed between and parallel to one or more of the plurality of micro dipole antennas in the plurality of macro composite dipole antennas.

3. The macro composite dipole antenna array of claim 1, wherein the array of the plurality of macro composite dipole antennas disposed on the substrate parallel to each other is disposed in a plurality of rows on the substrate, thus forming a two dimensional composite array.

4. The macro composite dipole antenna array of claim 1, wherein the array is disposed on two or more substrates arranged relative to each other, thus forming a two or three dimensional macro composite dipole antenna array.

5. The macro composite dipole antenna array of claim 1, wherein the plurality of micro dipole antennas each have an effective length corresponding to a half wavelength at a frequency approximately at the midpoint frequency between two selected frequencies f1 and f2, and each micro dipole antenna is resonant substantially at the midpoint frequency.

6. The macro composite dipole antenna array of claim 5, wherein each macro composite dipole antennas has an effective length l corresponding to a half wavelength at the difference frequency Δf=f1−f2, and wherein each macro composite dipole antenna is resonant at Δf.

7. The macro composite dipole antenna array of claim 6, wherein the reactive circuits behave substantially as a parallel resonant short circuits between each of the adjacent micro dipole antennas at the difference frequency Δf=f1−f2.

8. The macro composite dipole antenna array of claim 7, wherein the nonlinear component in the reactive circuit nonlinearly couples radiation at the two frequencies f1 and f2 to generate the difference frequency Δf=f1−f2.

9. The macro composite dipole antenna array of claim 1, wherein the nonlinear component in the reactive circuit is positioned in the reactive circuit at a location wherein the impedance of the nonlinear component is matched to the impedance of the quarter wave transmission line, thereby generating the difference frequency with maximum efficiency.

10. The macro composite dipole antenna array of claim 9, wherein the nonlinear component in the reactive circuit is a diode.

11. The macro composite dipole antenna array of claim 5, wherein the non-conducting substrate is characterized by a dielectric constant, the micro dipole antennas are conductive strips characterized by a thickness t normal to the surface of the substrate, and a width w in the plane of the substrate perpendicular to the length.

12. The macro composite dipole antenna array of claim 11, wherein the plurality of micro dipole elements are conductive strips characterized by a thickness t' normal to the surface of the substrate, a length l', where l' is equal to or less than 1, and a width w' in the plane of the substrate perpendicular to the length l'.

13. The macro composite dipole antenna array of claim 12, wherein the micro dipole elements are spaced apart from each other by a spacer distance s on the surface of the substrate.

14. The macro composite dipole antenna array of claim 13, wherein the first dipole element and the last dipole element of each plurality of micro dipole elements are parallel and spaced apart from respective adjacent micro dipole antennas by a spacer distance s'.

15. The macro composite dipole antenna array of claim 14, wherein, based at least on the substrate dielectric constant, conductor thicknesses t and t', lengths l and l', widths w and w', and spacer distances s and s', the micro dipole antennas and micro dipole elements couple electromagnetically to provide a multi-pole coupled bandwidth from frequencies f1 to f2 corresponding to the difference frequency Δf=f1−f2.

* * * * *